US008998669B2

(12) United States Patent
Boren

(10) Patent No.: US 8,998,669 B2
(45) Date of Patent: Apr. 7, 2015

(54) METHOD AND APPARATUS FOR A TWO-STAGE MODEL ROCKET

(71) Applicant: Estes-Cox Corp., Penrose, CO (US)

(72) Inventor: John G. Boren, Pueblo, CO (US)

(73) Assignee: Estes-Cox Corp., Penrose, CO (US)

( * ) Notice: Subject to any disclaimer, the term of this patent is extended or adjusted under 35 U.S.C. 154(b) by 252 days.

(21) Appl. No.: 13/920,793

(22) Filed: Jun. 18, 2013

(65) Prior Publication Data

US 2014/0370776 A1 Dec. 18, 2014

(51) Int. Cl.
*A63H 27/26* (2006.01)

(52) U.S. Cl.
CPC ..... *A63H 27/06* (2013.01)

(58) Field of Classification Search
USPC ..... 446/56
See application file for complete search history.

(56) References Cited

U.S. PATENT DOCUMENTS

| | | | | |
|---|---|---|---|---|
| 3,049,832 | A | 8/1962 | Joffe | |
| 3,091,052 | A | 5/1963 | Ryan | |
| 3,228,141 | A | 1/1966 | Bross | |
| 3,229,418 | A | 1/1966 | Dragich | |
| 3,292,302 | A | 12/1966 | Estes et al. | |
| 3,550,313 | A | 12/1970 | Pippin, Jr. | |
| 3,650,214 | A | 3/1972 | Green | |
| 3,721,193 | A * | 3/1973 | Piester | 102/352 |
| 3,820,275 | A | 6/1974 | Green | |
| 3,903,801 | A | 9/1975 | Senoski | |
| 3,943,656 | A | 3/1976 | Green | |
| 3,962,818 | A | 6/1976 | Pippin, Jr. | |
| 4,295,290 | A | 10/1981 | Boswell | |
| 4,355,577 | A | 10/1982 | Ady et al. | |
| 5,267,885 | A | 12/1993 | Niskern et al. | |
| 5,507,451 | A | 4/1996 | Karnish | |
| 5,712,446 | A | 1/1998 | Spence | |
| 2008/0289530 | A1 * | 11/2008 | Adorjan et al. | 102/348 |

OTHER PUBLICATIONS

International Search Report and Written Opinion issued in related application PCT/US2014/041347, Oct. 24, 2014, 9 pages.

* cited by examiner

*Primary Examiner* — Michael Dennis
(74) *Attorney, Agent, or Firm* — Drinker Biddle & Reath LLP

(57) ABSTRACT

A reconfigurable model rocket that can be flown either in a single-stage or a two-stage configuration is disclosed. The model rocket has a main body tube, a nose cone, a first tail section, a second tail section, and a staging adapter. The nose cone is removably coupleable to a top end of the main body tube and the first tail section is removably coupleable to a bottom end of the main body tube. The first tail section accommodates a first rocket engine to propel the model rocket by allowing gases from a combustible propellant to escape from the bottom end of the first tail section. The second tail section is removably coupleable to a bottom end of the first tail section and accommodates a second rocket engine to propel the model rocket by allowing gases from a combustible propellant to escape from the bottom end of the second tail section.

19 Claims, 8 Drawing Sheets

METHOD AND APPARATUS FOR A TWO-STAGE MODEL ROCKET

BACKGROUND

1. Field

The disclosed embodiments relate to the field of model rockets.

2. Related Art

In the field of model rocketry, multi-stage rockets have been known for many years. Generally each stage of a multi-stage rocket carries a combustible propellant that generates exhaust gases that exit the bottom end of the rocket so as to propel it on its flight. Such gases in one stage also act to ignite the propellant in the next stage. Conventional multi-stage model rockets are configured such that when a given stage has expended its combustible propellant it separates from the rest of the rocket and falls to the ground separately. As such, the various stages may get lost during their return fall to earth. In addition, failure of the second stage to ignite is not uncommon in such conventional multi-stage model rockets.

SUMMARY

The disclosed embodiments provide a reconfigurable model rocket that can be flown in a single-stage or dual-stage configuration. Further, a staging adapter cooperates with a corresponding staging cone so as to efficiently provide combustion gases from the booster stage to the upper stage to optimally ignite the upper stage of the rocket.

In a first embodiment, a reconfigurable model rocket is disclosed. The model rocket has a main body tube, a nose cone, a first tail section, a second tail section, and a staging adapter. The main body tube has top and bottom ends. The nose cone may be removably coupleable to the top end of the main body tube. The first tail section has top and bottom ends; the top end of the first tail section may be removably coupleable to the bottom end of the main body tube. The first tail section accommodates a first rocket engine having a combustible propellant to propel the model rocket by allowing gases from the combustible propellant to escape from the bottom end of the first tail section.

The second tail section has top and bottom ends; the top end of the second tail section may be removably coupleable to the bottom end of the first tail section. The second tail section accommodates a second rocket engine having a combustible propellant to propel the model rocket by allowing gases from the combustible propellant to escape from the bottom end of the second tail section.

The staging adapter may be removably coupleable to the bottom end of the first tail section and removably coupleable to the top end of the second tail section so as to couple the first and second tail sections together to provide a multi-stage configuration.

The model rocket is reconfigurable so as to be flown either as a single stage rocket or as a two-stage rocket. When flown in a single-stage configuration, the rocket comprises the main body, the nose cone, and the first tail section. When flown in a two-stage configuration, the rocket comprises the main body, the nose cone, the first tail section, a staging adapter, and the second tail section.

In a further embodiment, the second tail section further comprises a staging cone at the top end of the second tail section. The staging cone is configured to transfer combustion gases from the top of the second tail section into the bottom of the first tail section, via the staging adapter, so as to ignite the first rocket engine when the combustible propellant of the second rocket engine has been depleted.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form a part of the specification, illustrate the present invention and together with the written description further serve to explain the principles of the invention and to enable a person skilled in the relevant art to make and use the invention.

Figure 1:
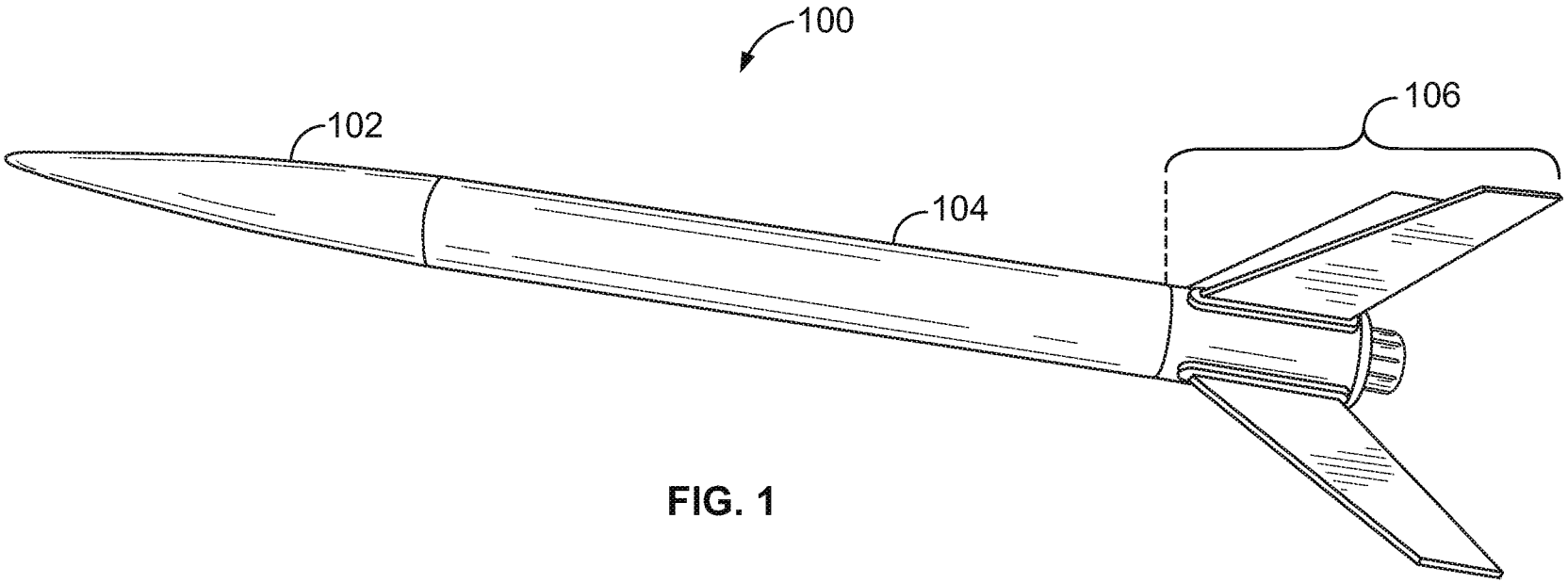
FIG. 1 is an illustration of a fully assembled reconfigurable model rocket in a single-stage configuration, according to an embodiment.

A detailed description of various embodiments is set forth below and corresponds to the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

It is to be appreciated that any additional disclosure found in the Figures is meant to be exemplary and not limiting to any of the features shown in the Figures and described in the specification below.

DETAILED DESCRIPTION

The disclosed embodiments provide a model rocket that is reconfigurable as a single or dual stage rocket. In the dual-stage configuration a booster rocket engine having a combustible propellant propels the rocket for a first time duration and then an upper rocket engine propels the rocket for a second time duration. When the booster rocket engine has expended its propellant it provides combustion gases to the upper rocket engine and ignites the upper rocket engine.

For simplicity of discussion, through the following specification, the words "first" and "second" are used to describe various components based on when a given component is first mentioned. Thus the term "first tail section" and "first rocket engine," etc., thus does not denote anything regarding the temporal sequence in which the various stages are fired. Thus, for example, in one embodiment the "first tail section" corresponds to the upper section while the "second tail section" corresponds to the booster section although the booster section is fired before the upper section.

This specification discloses one or more embodiments that incorporate the features of this invention. The disclosed embodiment(s) merely exemplify the invention. The scope of the invention is not limited to the disclosed embodiment(s). The invention is defined by the claims appended hereto.

The embodiment(s) described, and referenced in the specification to "one embodiment," "an embodiment," "an example embodiment," etc., indicate that the embodiment(s) described may include a particular feature, structure, or characteristic, but each embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

FIG. 1 is an illustration of a fully assembled reconfigurable model rocket 100 in a single-stage configuration, according to an embodiment. The rocket includes a nose cone 102, a main body tube 104, and a first tail section 106. The various components of the model rocket 100 are described in further detail below.

Figure 2:
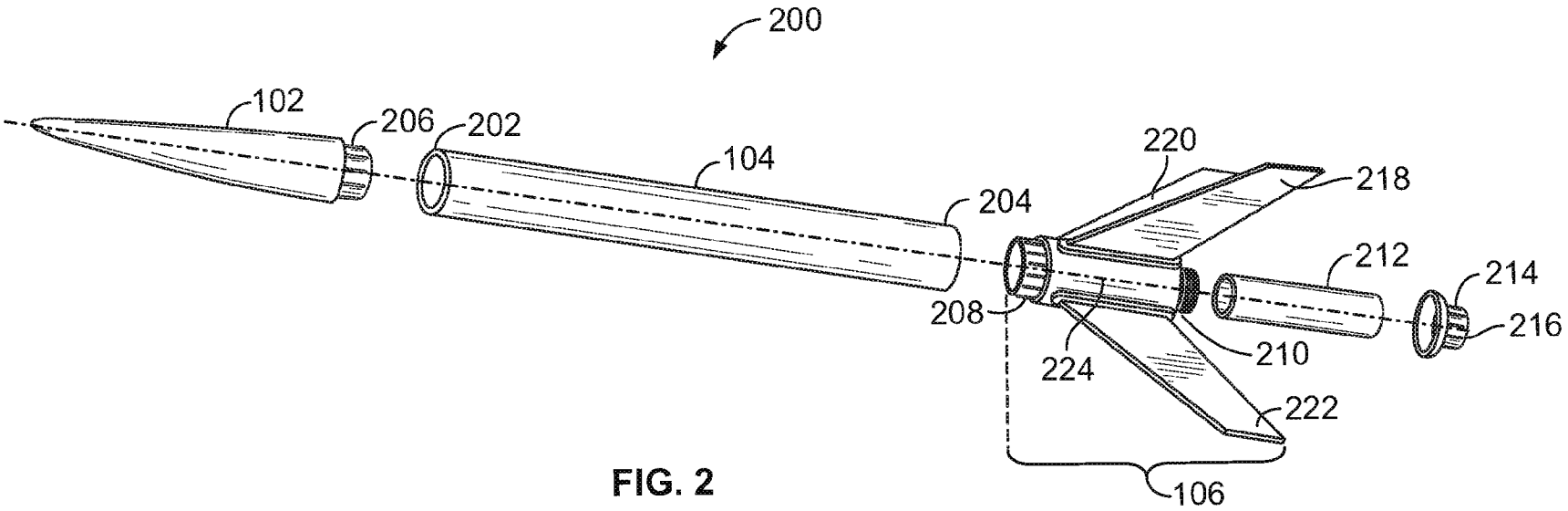
FIG. 2 is an exploded view of the model rocket of FIG. 1.

FIG. 2 is an illustration of the rocket of FIG. 1 in a disassembled state 200. The main body tube 104 has a top end 202 and a bottom end 204. The bottom end 206 of the nose cone 102 is removably coupleable to the top end 202 of the main body tube 104. The first tail section 106 has a top end 208 and a bottom end 210. In an embodiment, the top end 208 of the first tail section 106 is glued into the bottom end 204 of the main body tube.

The various components of the model rocket may be of various sizes. For example, the body tube may be of different sizes, such as a BT-50, a BT-55 or BT-60 body tube. Body tubes BT-50, BT-55, and BT-60 are standard model rocket body tubes commercially available from Estes-Cox® Corporation (www.estesrockets.com) having the following specifications. The BT-50 body tube has inside dimension: 0.950 in (24.1 mm), outside dimension: 0.976 in (24.8 mm), and length: 18 in (45.7 cm); the BT-55 body tube has inside dimension: 1.283 in (32.6 mm), outside dimension: 1.33 in (34 mm), and length: 18 in (45.7 cm); and the BT-60 body tube has inside dimension: 1.595 in (40.5 mm), outside dimension: 1.64 in (42 mm), and length: 18 in (45.7 cm).

The first tail section 106 accommodates a first rocket engine 212 having a combustible propellant to propel the model rocket. The first rocket engine 212 fits inside an internal chamber (described further below) of the first tail section 106 and is secured by an engine retainer 214 to the bottom end 210 of the first tail section 106. The first rocket engine 212 propels the rocket by generating combustion gases that are expelled through the bottom end 210 of the first tail section and escape through an outlet 216 in the engine retainer 214.

The first tail section 106 also includes a plurality of fins 218, 220, and 222, protruding from an external surface 224 of the first tail section 106 to provide aerodynamic stability to the model rocket in flight.

Figure 3:
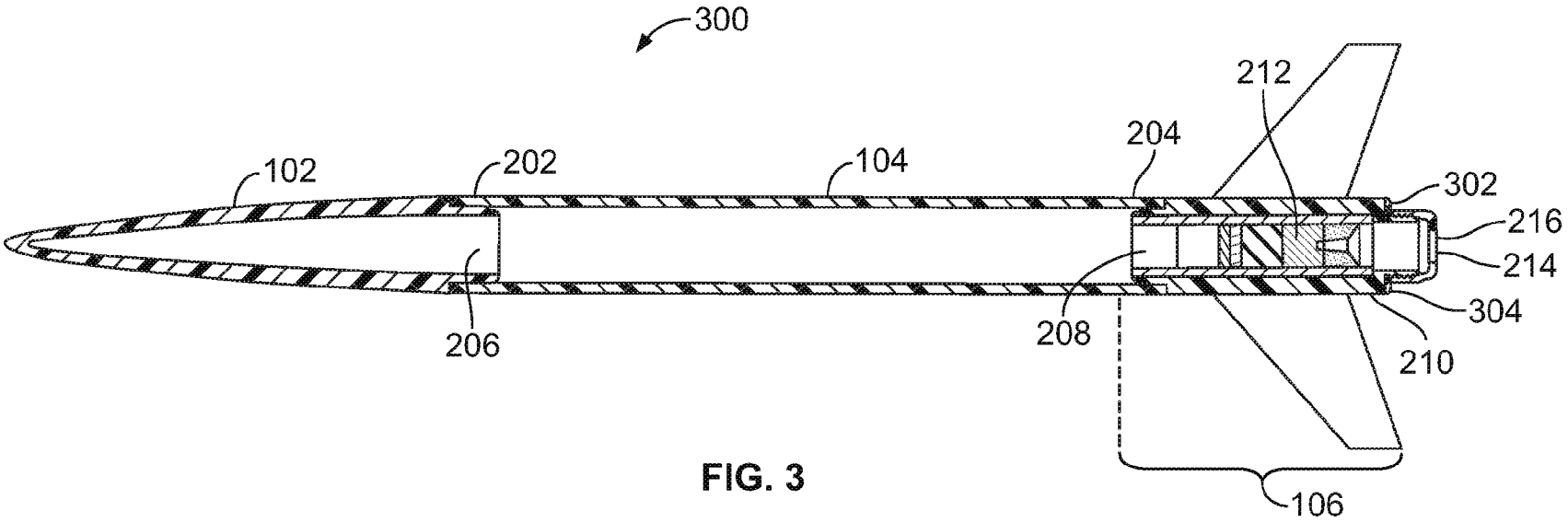
FIG. 3 is a cross-sectional illustration of the fully assembled reconfigurable model rocket of FIG. 1.

FIG. 3 is a cross-sectional illustration 300 of the fully assembled reconfigurable model rocket of FIG. 1. As shown, the bottom end 206 of the nose cone 102 is coupled to the top end 202 of the main body tube 104. Likewise, the top end 208 of the first tail section 106 is coupled to the bottom end 204 of the main body tube 104. The first tail section 106 comprises a hollow tube defined by a cylindrical structure having walls 302 and 304. The volume internal to the cylindrical walls 302 and 304 of the first tail section 106 forms an internal chamber to accommodate the rocket engine 212. In an example, the internal chamber may accommodate an 18 mm diameter rocket engine.

The engine retainer 214 is used when the model rocket is flown as a single-stage rocket. The first engine retainer 214 is removably coupleable to the bottom end 210 of the first tail section 106 to securely hold the first rocket engine 212 in the internal chamber of the first tail section 106. For example, the engine retainer 214 may take the form of a screw cap that can be screwed onto corresponding screw threads (not shown) at the bottom end 210 of the first tail section 106. The engine retainer 214 includes an outlet 216 to allow combustion propellant gases generated by the first rocket engine 212 to escape from the bottom end 210 of the first tail section 106 so as to propel the rocket.

Figure 4:
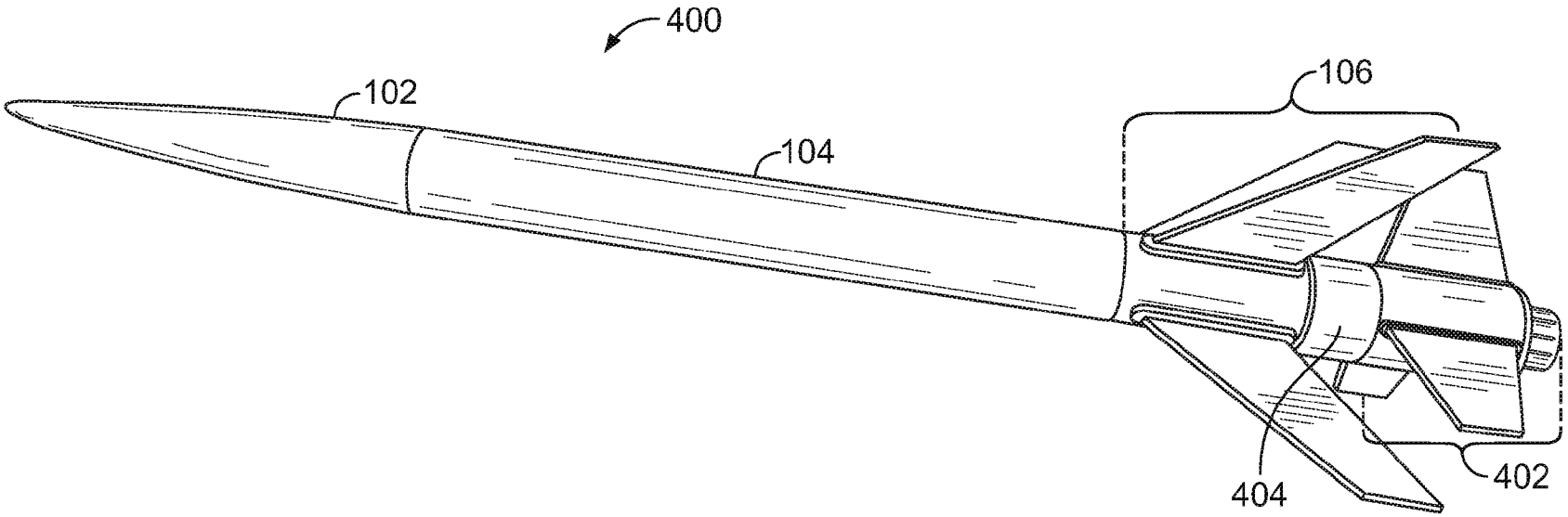
FIG. 4 is an illustration of a fully assembled reconfigurable model rocket in a dual-stage configuration, according to an embodiment.

FIG. 4 is an illustration of a fully assembled reconfigurable model rocket 400 in a dual-stage configuration, according to an embodiment. The rocket 400 includes a nose cone 102, a main body tube 104, a first tail section 106, a second tail section 402, and a staging adapter 404. The various components of the model rocket 400 are described in further detail below.

Figure 5:
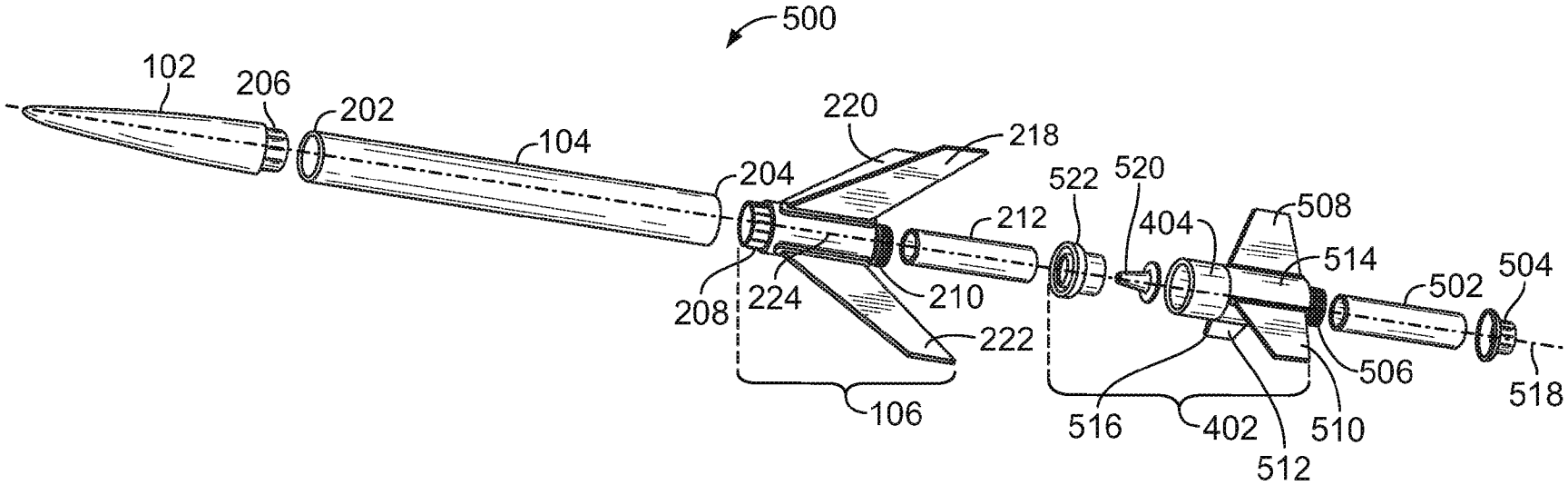
FIG. 5 is an exploded view of the model rocket of FIG. 4.

FIG. 5 is an illustration of the rocket of FIG. 4 in a disassembled state 500. The main body tube 104 has a top end 202 and a bottom end 204. The bottom end 206 of the nose cone 102 is removably coupleable to the top end 202 of the main body tube 104. The first tail section 106 has a top end 208 and a bottom end 210. In an embodiment, the top end 208 of the first tail section 106 is glued into the bottom end 204 of the main body tube.

The first tail section 106 accommodates a first rocket engine 212 having a combustible propellant to propel the model rocket. The first rocket engine 212 fits inside an internal chamber (described further below) of the first tail section 106 and is secured by the staging adapter 404 (described further below) to the bottom end 210 of the first tail section 106. The first rocket engine 212 propels the rocket by generating combustion gases that are expelled through the bottom end 210 of the first tail section. The first rocket engine 212 propels the rocket after the combustible propellant in a second rocket engine (described below) located in the second tail section 402 has been depleted.

The first tail section 106 also includes a plurality of fins 218, 220, and 222, protruding from an external surface 224 of the first tail section 106 to provide aerodynamic stability to the model rocket in flight.

The second tail section 402 accommodates a second rocket engine 502 having a combustible propellant to propel the model rocket. The second rocket engine 502 fits inside an internal chamber (described further below) of the second tail section 402 and is secured by an engine retainer 504 to the bottom end 506 of the second tail section 402. The second rocket engine 502 propels the rocket by generating combustion gases that are expelled through the bottom end 506 of the second tail section 402.

The second tail section 402 also includes a plurality of fins 508, 510, and 512, protruding from an external surface 514 of the second tail section 402 to provide aerodynamic stability to the model rocket in flight.

When operated as a two stage rocket, the second rocket engine 502 is ignited first and propels the rocket for a first time duration. When the combustible propellant of the second rocket engine 502 is depleted, combustion gases are provided from the top 516 of the second tail section 402 into the bottom 210 of the first tail section so as to ignite the first rocket engine 212.

The first 212 and second 502 rocket engines are conventional rocket engines in the sense that each one is a hollow tube filed with a solid combustible propellant prior to ignition of the engine. As the engine burns, the combustible propellant is consumed and propellant gases are ejected from the bottom of the engine so as to propel the rocket. As the engine burns, the propellant is consumed by a flame front that moves upward until the propellant is exhausted. As the flame front reaches the top of the engine gases also propagate upwardly from the top of the engine. In this way, the first rocket engine 212 is ignited by the gases propagating upwardly from the nearly consumed second rocket engine 502. In addition to causing the ignition of 212, pressure from hot gasses coming from the top of second engine 502 help to push or discharge the booster (second tail section 402), which then tumbles to the ground.

The second tail section 402 further includes a staging cone 520 at the top end of the second tail section. The staging cone 520 fits into an upper stage thread-on adapter 522. The upper stage thread-on adapter 522 screws onto the lower end 210 of the first tail section 106. The upper stage thread-on adapter 522 is coupled to the staging adapter 404 in such a way as to allow to first tail section 106 and second tail section 402 to separate when the first engine 212 is ignited.

The staging cone 520 is configured to efficiently transfer combustion gases from the top 516 of the second tail section, through the staging adapter 404, and into the bottom 210 of the first tail section 106 so as to ignite the first rocket engine 212 when the combustible propellant of the second rocket engine 502 has been depleted. Upon ignition of the first engine 212, the staging adapter 404 separates from the upper stage thread-on adapter 522 so as to allow the second tail section 402 to separate from the first tail section 106.

The upper stage thread-on adapter 522 performs the following functions. In the first instance, the upper stage thread-on adapter 522 securely holds the first rocket engine 212 in the internal chamber of the first tail section 106. It also receives combustion gases from the top 516 of the second tail section 402 from the staging cone 520 and conveys them to the first rocket engine 212 so as to ignite the first rocket engine 212 when the combustible propellant of the second rocket engine 502 has been depleted.

The engine retainer 504 may take the form of a screw cap that can be screwed onto corresponding screw threads (not shown) at the bottom end 506 of the second tail section 402. Similarly, the staging adapter 404 may be coupled to the first 106 and second 402 tail sections by a screw-on mechanism.

Figure 6:
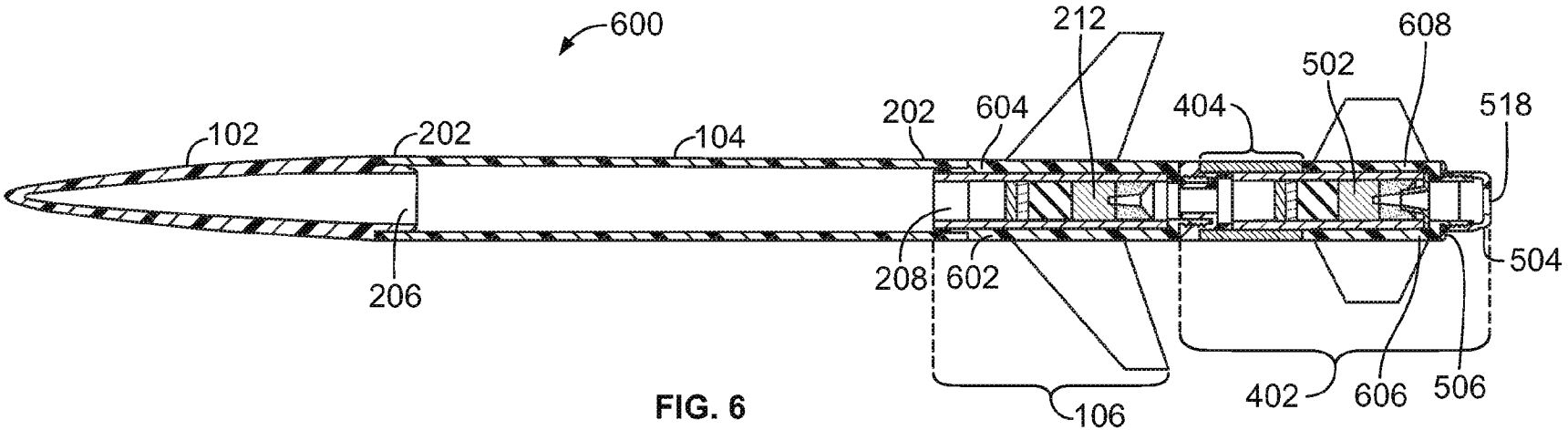
FIG. 6 is a cross-sectional illustration of the fully assembled reconfigurable model rocket of FIG. 4.

FIG. 6 is a cross-sectional illustration 600 of the fully assembled reconfigurable model rocket of FIG. 5. As shown, the bottom end 206 of the nose cone 102 is coupled to the top end 202 of the main body tube 104. Likewise, the top end 208 of the first tail section 106 is coupled to the bottom end 202 of the main body tube 104. The first tail section 106 comprises a hollow tube defined by a cylindrical structure having walls 602 and 604. The volume internal to the cylindrical walls 602 and 604 of the first tail section 106 forms an internal chamber to accommodate the first rocket engine 212. In an example, the internal chamber may accommodate a rocket engine having a 18 mm diameter.

Similarly, the second tail section 402 is coupled to the first tail section 106 by the staging adapter 404. The second tail section 402 comprises a hollow tube defined by a cylindrical structure having walls 606 and 608. The volume internal to the cylindrical walls 606 and 608 of the second tail section 402 forms an internal chamber to accommodate the second rocket engine 502.

The engine retainer 504 includes an outlet 518 to allow combustion propellant gases generated by the second rocket engine 502 to escape from the bottom end 506 of the second tail section 402 so as to propel the rocket.

Figure 7:
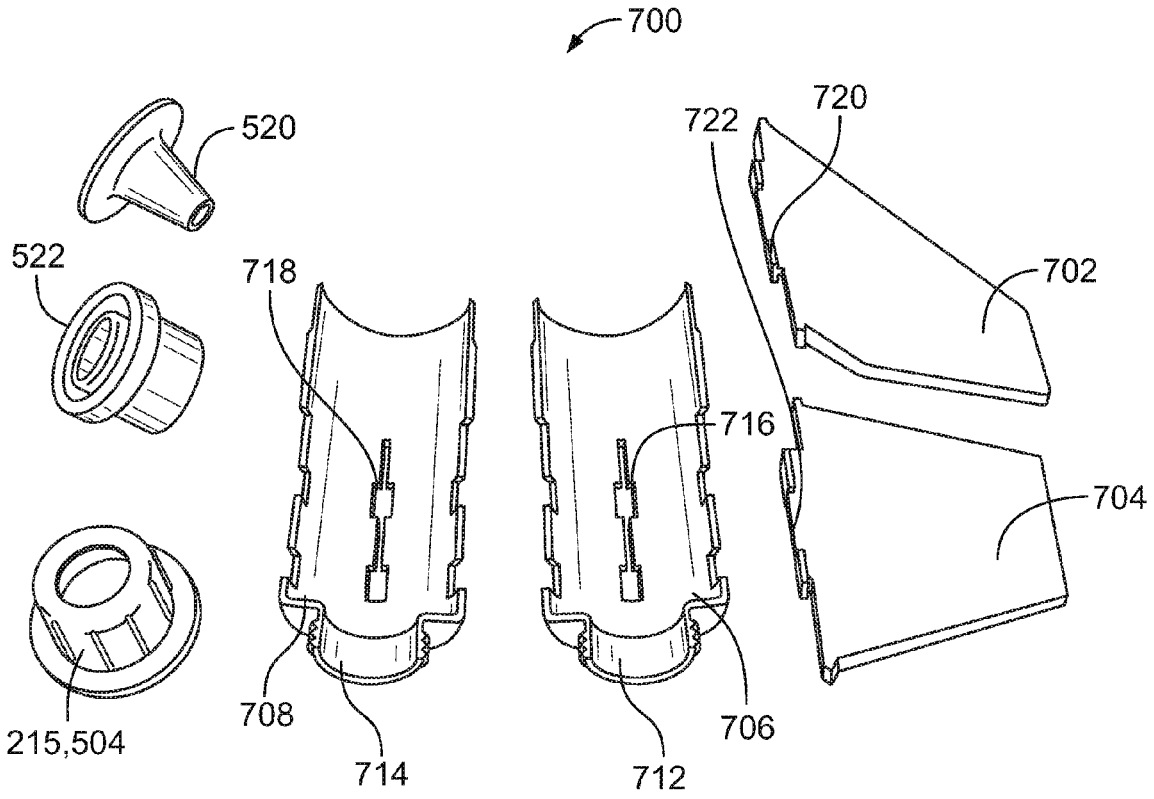
FIG. 7 is an illustration of component parts that may be assembled to form a first or section tail section of a reconfigurable model rocket, according to an embodiment.

FIG. 7 is an illustration of molded plastic parts that may be assembled to form a first or second tail section of a reconfigurable model rocket, according to an embodiment, including a first fin 702, a second fin 704, a first half of a cylindrical object 706, a second half of a cylindrical object 708, and an engine retainer 215 or 504. The first 706 and second 708 halves are configured so that they can be joined together to form a cylindrical tube (described below). Each of the first 706 and second 708 halves include screw threads (712 and 714, respectively) that match corresponding threads in the engine retainer 215 or 504 (not shown). Each of the first 706 and second 708 halves include slots (716 and 718, respectively) to accommodate corresponding tabs 720 and 722 on the respective fins 702 and 704. The fins 702 and 704 can be easily fastened to the corresponding parts 706 and 708, respectively by sliding the tabs 720 and 722 into the slots 716 and 718.

In further embodiments, the first or section tail sections may include three or more fins. Further, the fins may be glued into the slots of the first and second halves of the cylindrical object. In other embodiments, the fins may be secured into the cylindrical objects by mechanical pressure provided by contact with the engine retainer.

Elements associated with the staging adapter 404 are also shown. These include the staging cone 520 and the upper stage thread-on adapter 522. The relation of these elements to the first tail section 106 and second tail section 402 was discussed above with reference to FIG. 5. The staging adapter further comprises a hollow tube 404 that is configured to slideably couple to the top end of the second tail section and to the upper stage thread-on adapter 522 so as to allow to first tail section and second tail section to slideable separate when the first engine is ignited.

Figure 8:
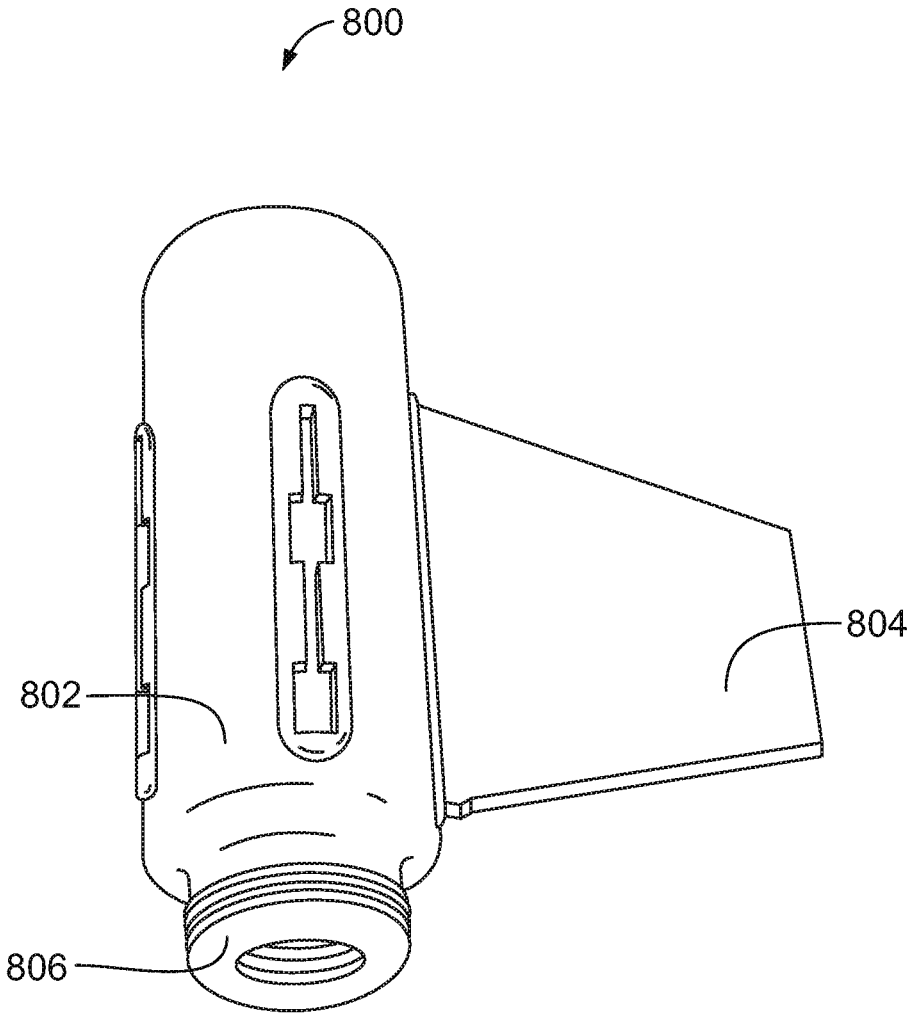
FIG. 8 is an illustration showing partially assembled component parts forming part of a first or section tail section of a reconfigurable model rocket, according to an embodiment.

FIG. 8 is an illustration of partially assembled molded plastic parts forming part of a first or second tail section of a reconfigurable model rocket, according to an embodiment. The two parts 706 and 708 have been assembled into a cylindrical tube 802. One of the fins 804 has been fastened to the cylindrical tube 802 as described above. As can be seen, threads of the cylindrical tube 802 are provided to accommodate screwing the retainer 806 onto the cylindrical tube 802.

In further embodiments, other components of the reconfigurable model rocket may be manufactured from molded plastic. Such components may include the nose cone, the staging adapter, etc. In other embodiments, components such as the body tube may be manufactured from cardboard. Some components, such as the staging adapter may include both molded plastic components and cardboard components.

In further embodiments, the fins may have a plurality of shapes and sizes. The cylindrical tube object 802 may have one of a plurality of sizes. The tabs of the plurality of fins and the slots of the cylindrical tube object each respectively may have fixed sizes so that any one of the plurality of fins can be interchangeably fastened to cylindrical tube object irrespective of the size of the cylindrical tube object. In further embodiments, the fins of the first and second tail section may be configured to be interchangeable with one another.

In further embodiments, the model rocket may be are provided as a kit including a colored body tube, and wherein the kit requires only minor assembly. As such, the model rocket may be provided to a consumer in an "almost ready to fly" configuration. In a further embodiment, a model rocket as described above, when flown in a dual-stage configuration may be flown to altitudes of at least two times the altitude that it reaches when flown as a single-stage rocket.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The terminology used herein is for the purpose of describing the embodiments and is not intended to be limiting of exemplary embodiments of the invention. In the description of the embodiments, certain detailed explanations of related art are omitted when it is deemed that they may unnecessarily obscure the essence of the invention.

The invention may be described in terms of functional block components and various processing steps. It should be noted that many alternative or additional functional relationships, physical connections or logical connections may be present in a practical device. The words "mechanism," "element," "unit," "structure," "means," and "construction" are used broadly and are not limited to mechanical or physical embodiments, but may include software routines in conjunction with processors, etc.

The use of any and all examples, or exemplary language (e.g., "such as") provided herein, is intended merely to better illuminate embodiments and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as essential or critical. It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. A reconfigurable model rocket comprising:

a main body tube having top and bottom ends;

a nose cone removably coupleable to the top end of the main body tube;

a first tail section, having top and bottom ends, wherein the top end of the first tail section is secured to the bottom end of the main body tube, wherein the first tail section accommodates a first rocket engine having a combustible propellant to propel the model rocket by allowing gases from the combustible propellant to escape from the bottom end of the first tail section;

a second tail section, having top and bottom ends, wherein the top end of the second tail section is removably coupleable to the bottom end of the first tail section, wherein the second tail section accommodates a second rocket engine having a combustible propellant to propel the model rocket by allowing gases from the combustible propellant to escape from the bottom end of the second tail section;

a staging adapter that is removably coupleable to the bottom end of the first tail section and removably coupleable to the top end of the second tail section so as to couple the first and second tail sections together, the staging adapter conveys the combustion gases to the first rocket engine to ignite the first rocket engine when the combustible propellant of the second rocket engine has been depleted; and wherein the model rocket can be reconfigured to be flown both as: (1) as a single stage rocket in a first configuration comprising the main body, the nose cone, the first tail section, and without the staging adapter, and (2) as a dual-stage rocket in a second configuration comprising the main body, the nose cone, the first tail section, the staging adapter, and the second tail section.

2. The model rocket of claim 1, wherein the first tail section further comprises:

an internal chamber to accommodate the first rocket engine;

an engine retainer that is used when the model rocket is flown as a single-stage rocket, wherein the first engine retainer is removably coupleable to the bottom end of the first tail section to securely hold the first rocket engine in the internal chamber of the first tail section, and wherein the first engine retainer comprises an outlet to allow combustion propellant gases to escape from the bottom end of the first tail section so as to propel the rocket; and a plurality of fins protruding from an external surface of the first tail section to provide aerodynamic stability to the model rocket in flight.

3. The model rocket of claim 2, wherein the internal chamber of the first tail section further is configured to accommodate the first rocket engine, wherein the first rocket engine has an 18 mm diameter.

4. The model rocket of claim 1, wherein the second tail section further comprises:

an internal chamber to accommodate the second rocket engine;

an engine retainer removably coupleable to the bottom end of the second tail section to securely hold the second rocket engine in the internal chamber of the second tail section, and wherein the second engine retainer comprises an outlet to allow combustion propellant gasses to escape from the bottom end of the second tail section so as to propel the rocket;

a staging cone at the top end of the second tail section, wherein the staging cone is configured to transfer combustion gases from the top of the second tail section into the bottom of the first tail section so as to ignite the first rocket engine when the combustible propellant of the second rocket engine has been depleted; and a plurality of fins protruding from an external surface of the second tail section to provide aerodynamic stability to the model rocket in flight.

5. The model rocket of claim 4, wherein the internal chamber of the second tail section further is configured to accommodate the second rocket engine, wherein the second rocket engine has a mom diameter.

6. The model rocket of claim 4, wherein:

the staging cone fits into an upper stage thread-on adapter, wherein the upper stage thread-on adapter has screw threads and is configured to screw onto corresponding screw threads on the bottom end of the first tail section, and wherein the upper stage thread-on adapter is coupled to the staging adapter so as to allow to first tail section and second tail section to separate when the first engine is ignited.

7. The model rocket of claim 4, wherein:

the staging cone is secured to the second tail section, the upper stage thread-on adapter is screwed onto the bottom end of the first tail section, and wherein the staging adapter further comprises a hollow tube that is configured to slideably couple to the top end of the second tail section and to the upper stage thread-on adapter so as to allow to first tail section and second tail section to slideable separate when the first engine is ignited.

8. The model rocket of claim 1, wherein:

the first tail section further comprises an internal chamber to accommodate the first rocket engine, and the second tail section further comprises an internal chamber to accommodate the second rocket engine, wherein the first rocket engine has an 18 mm diameter and the second rocket engine has a 24 mm diameter.

9. The model rocket of claim 8, wherein the first and second tail sections are configured such that, when flown as a dual-stage rocket, the rocket reaches an altitude that is at least two times an altitude that it reaches when flown as a single-stage rocket.

10. The model rocket of claim 1, wherein a first or second tail section comprises:

a first half cylindrical section having slots in a cylindrical surface and a threaded end member;

a second half cylindrical section having slots in a cylindrical surface and a threaded end member;

a first fin having tabs corresponding to the slots in the first half cylindrical section;

a second fin having tabs corresponding to the slots in the second half cylindrical section; and an engine retainer having a threaded portion, wherein the first and second half cylindrical section can be assembled to form a cylindrical tube object having slots on two cylindrical surfaces and a threaded end member on one end of the tube object, the fins can be fastened to the cylindrical tube object by sliding the tabs of each fin into corresponding slots on the cylindrical tube object, and the threaded portion of the engine retainer can be screwed onto the threaded end member of the cylindrical tube object.

11. The model rocket of claim 10, wherein the first or second tail sections comprise molded plastic components.

12. The model rocket of claim 10, wherein the first or second tail sections comprise three or more fins.

13. The model rocket of claim 10, wherein the fins are glued to the cylindrical tube object.

14. The model rocket of claim 10, wherein the fins are secured to the cylindrical tube object by mechanical pressure provided by contact with the engine retainer.

15. The model rocket of claim 10, wherein:

the first and second half cylindrical sections comprise either a first or second size so that, when assembled, they comprise the cylindrical tube object having a first or second diameter, and wherein the slots in the first and second half cylindrical sections have a fixed size independently of whether the cylindrical tube object has the first or second diameter, so that the fins having a single fixed size can be interchangeably fastened to the cylindrical tube object independently of whether the cylindrical tube object has the first or second diameter.

16. The model rocket of claim 15, further comprising:

fins having a plurality of shapes and sizes;

the cylindrical tube object having one of a plurality of sizes, and wherein the tabs of the plurality of fins and the slots of the cylindrical tube object each respectively have fixed sizes so that any one of the plurality of fins can be interchangeably fastened to cylindrical tube object irrespective of the size of the cylindrical tube object.

17. The model rocket of claim 16, wherein the fins of the first tail section and the second tail section are configured to be interchangeable with one another.

18. The model rocket of claim 1, wherein the size of the body tube is a BT-50, BT-55 or a BT-60 body tube.

19. The model rocket of claim 1, wherein the component parts of the model rocket are provided as a kit comprising a colored body tube, and wherein the kit requires only minor assembly.

* * * * *